US005146764A

United States Patent [19]

Bauman et al.

[11] Patent Number: 5,146,764

[45] Date of Patent: Sep. 15, 1992

[54] SYSTEM AND METHOD FOR CONTROLLING A VARIABLE GEOMETRY DIFFUSER TO MINIMIZE NOISE

[75] Inventors: Bruce K. Bauman, Glen Rock; Charles F. Boal, Greensburg, both of Pa.

[73] Assignee: York International Corporation, York, Pa.

[21] Appl. No.: 557,009

[22] Filed: Jul. 25, 1990

[51] Int. Cl.[5] ..... F25B 49/00

[52] U.S. Cl. ..... 62/228.5; 62/201; 415/17; 415/48; 415/119; 415/150; 415/151

[58] Field of Search ..... 415/1, 17, 47, 48, 49, 415/150, 151, 126, 119; 62/115, 201, 226, 228.5

[56] References Cited

U.S. PATENT DOCUMENTS

| | | | |
|---|---|---|---|
| 4,265,091 | 5/1981 | Kobayashi . | |
| 4,503,684 | 3/1985 | Mount et al. . | |
| 4,539,821 | 9/1985 | Tamura . | |
| 4,570,450 | 2/1986 | Takemi et al. . | |
| 4,586,870 | 5/1986 | Hohlweg et al. | 415/27 |
| 4,611,969 | 9/1986 | Zinsmeyer | 415/1 |
| 4,616,483 | 10/1986 | Leonard | 62/228.5 |
| 4,686,834 | 8/1987 | Haley et al. . | |
| 4,780,049 | 10/1988 | Palmer et al. . | |
| 4,864,832 | 9/1989 | Suzuki . | |

*Primary Examiner*—Edward K. Look
*Assistant Examiner*—Christopher M. Verdier
*Attorney, Agent, or Firm*—Finnegan, Henderson, Farabow, Garrett & Dunner

[57] ABSTRACT

A method of controlling a centrifugal compressor having a variable width diffuser section, the compressor being part of a chiller having a condenser and an evaporator, the method including the steps of defining the width of the diffuser which results in an optimum noise and performance level at given values of an operational parameter of the compressor, periodically sensing the operational parameter of the compressor, and periodically varying the diffuser width according to the sensed operational parameter to create a diffuser width that results in the optimum noise and performance levels at the sensed value of the operational parameter. The step of defining preferably defines the width based at least on the capacity at which the compressor is operating. The capacity is preferably determined by measuring the flow and temperature difference of the fluid passing through the evaporator. A control system for controlling the chiller system to minimize noise is also disclosed.

22 Claims, 6 Drawing Sheets

SYSTEM AND METHOD FOR CONTROLLING A VARIABLE GEOMETRY DIFFUSER TO MINIMIZE NOISE

BACKGROUND OF THE INVENTION

1. Field of the Invention

The present invention relates to a system and method for controlling a variable geometry diffuser, and more specifically to controlling the diffuser to minimize noise, without adversely affecting performance.

2. Description of the Related Art

Conventional compressors used in chiller systems may be operated over a broad range of capacities in order to meet the load requirements. Typically, a chiller system is designed to keep the chilled water produced by the chiller at a preselected temperature, or temperature range. As the cooling load varies, it is necessary to vary the capacity of the compressor, in order to keep the chilled water at the preselected temperature.

As the capacity of a compressor varies, the noise generated by the compressor will also vary, particularly if no other changes in the compressor operation are made. In addition, as capacity varies, it is necessary to stabilize the fluid flow through the compressor. Unstable flow creates turbulence which causes vibration and a decrease in efficiency and which in the extreme can cause surge which is a complete reversal of the flow. If left uncorrected, surge will cause damage to the compressor.

In order to increase the stability of fluid flow in the compressor, compressors have been developed which are capable of varying the geometry of the diffuser. For example, U.S. Pat. No. 4,527,949 to Kirtland, U.S. Pat. No. 416,583 to Byrns, and U.S. Pat. No. 3,032,259 to Jassniker disclose variable geometry diffusers. Such devices require a system to control the varying geometry of the diffuser so as to increase the stability of the flow. Such control systems are generally designed to maintain compressor operator at a specific level of stability or efficiency. For example, U.S. Pat. No. 4,503,684 to Mount et al. discloses a control system which maintains flow as close to the point of surge as possible in order to maximize efficiency.

Although methods and systems have been developed to prevent surge or maximize efficiency, to the inventors' knowledge, no methods have been developed to minimize the noise produced by a chiller system having a variable geometry compressor, while still providing acceptable performance. The need for a chiller system that minimizes noise has existed for a considerable time. For example, a chiller system for submarines is an example where noise minimization is critical. In addition, the reduction of noise in other commercial applications of chiller systems is also preferred. It is therefore desirable to have a method and control system for controlling a variable geometry compressor so that noise is minimized.

SUMMARY OF THE INVENTION

An object of the invention is to provide a method for controlling a variable geometry compressor to minimize noise, without unduly sacrificing performance.

Another object is to provide a control system for controlling a variable geometry compressor to minimize noise.

Additional objects and advantages of the invention will be set forth in part in the description which follows, and in part will be obvious from the description, or may be learned by practice of the invention. The objects and advantages of the invention will be realized and attained by means of the elements and combinations particularly pointed out in the appended claims.

To achieve the objects and in accordance with the purpose of the invention, as embodied and broadly described herein, the invention comprises a method of controlling a centrifugal compressor having a variable width diffuser to minimize noise generation, the method comprising the steps of defining the width of the diffuser which results in an optimum level of noise generation and performance at given values of an operational parameter of the compressor; periodically sensing the operational parameter of the compressor; and periodically varying the diffuser width according to the sensed operational parameter to effect a diffuser width that results in the acceptable noise and performance at the sensed value of the operational parameter.

Preferably, the step of defining defines the width based at least on the capacity at which the compressor is operating. The capacity is preferably determined by measuring the flow and temperature difference of the water passing through the evaporator. Further preferably, the width of the diffuser section is defined to be 100% of the maximum width when the capacity is 90% to 100%, and the width is defined to linearly vary from less than 20% of the maximum width at a capacity of less than 20% to 100% of the maximum width at more than 80% capacity.

To achieve the objects and in accordance with the purpose of the invention, the invention further comprises a control system for a centrifugal compressor having pre-rotation vanes and a variable width diffuser, the device comprising means for controlling the position of the pre-rotation vanes to achieve a desired capacity; means for sensing a parameter representative of the capacity of the compressor; and means, interconnected with said sensing means, for controlling the width of the diffuser section to minimize noise generated by the compressor.

To achieve the objects and in accordance with the purpose of the invention, the invention further comprises a control system for a chiller system including a centrifugal compressor having variable pre-rotation vanes and a variable width diffuser; an evaporator heat exchanger for producing chilled water; a condenser heat exchanger; and an expansion device; the system comprising first means for sensing the water temperature of the chilled water produced by the evaporator heat exchanger and developing an error signal representative of the difference between the sensed water temperature and a preselected desired water temperature; second means for sensing at least one additional operational parameter of the chiller system; third means for varying the position of the pre-rotation vanes; fourth means for varying the width of the variable width diffuser; and control means, interconnected with said first, second, third and fourth means, for periodically varying the position of the pre-rotation vanes to minimize the error signal and for periodically varying the width of the variable width diffuser to achieve optimum noise generation and performance, according to a predetermined relationship between the additional operational parameter and the width of the variable width diffuser.

It is to be understood that both the foregoing general description and the following detailed description are exemplary and explanatory only and are not restrictive of the invention as claimed.

The accompanying drawings, which are incorporated in and constitute part of the specification, illustrate an embodiment of the invention and, together with the description, serve to explain the principles of the invention.

DESCRIPTION OF THE PREFERRED EMBODIMENT

Reference will now be made in detail to the presently preferred embodiment of the invention, an example of which is illustrated in the accompanying drawings. Wherever possible, the same reference numbers will be used throughout the drawings to refer to the same or like parts.

Figure 1:
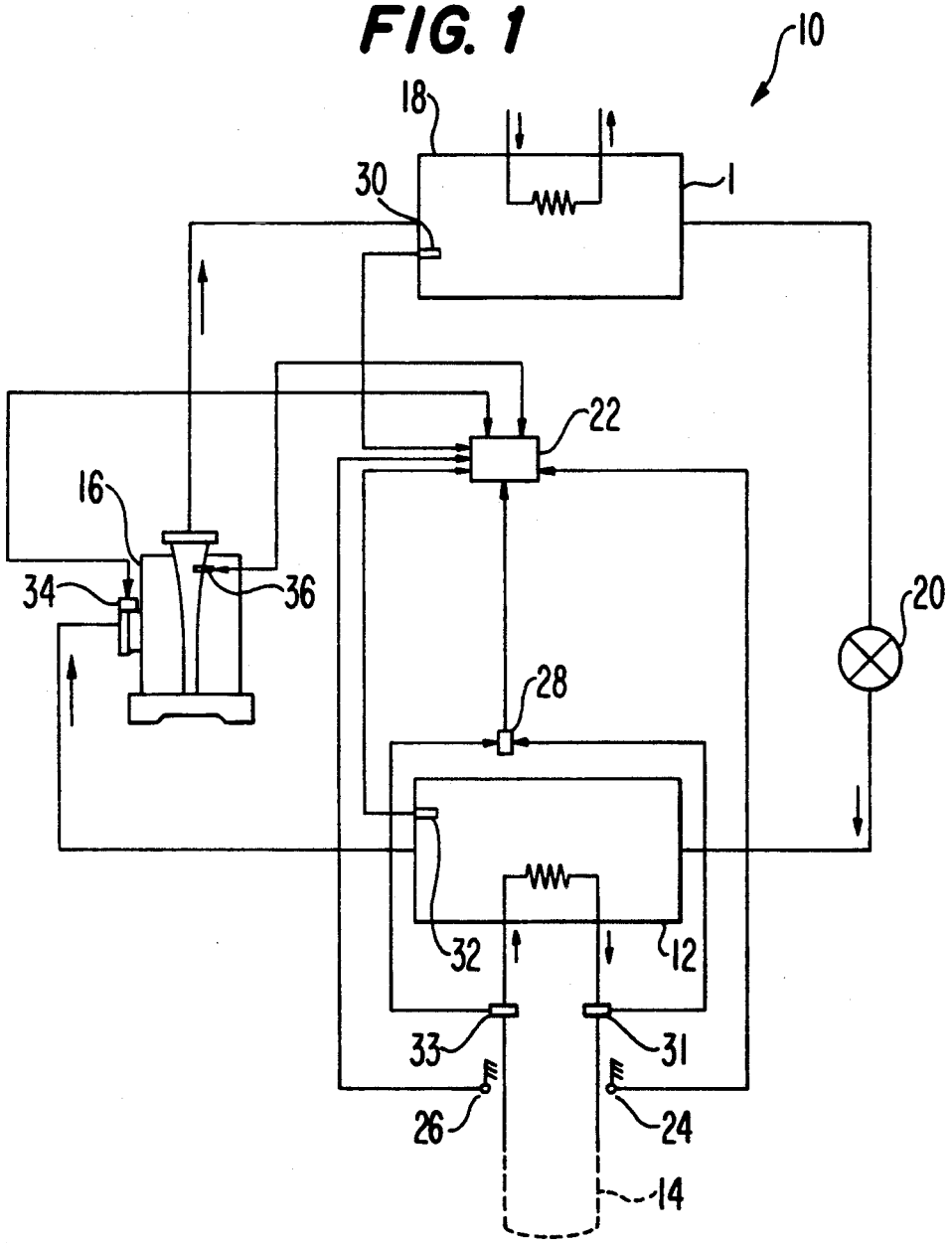
FIG. 1 is a schematic illustration of a chiller system incorporating a system according to the invention.

The present invention is directed to methods and control systems to minimize the noise generated by a chiller system while still obtaining acceptable performance levels. FIG. 1 shows a chiller system 10 in which the invention may be used. As is known, the fluid to be chilled is circulated through an evaporator heat exchanger 12 via flow circuit 14. Typically, the fluid chilled in the heat exchanger is water. As is further known, a refrigerant is circulated through the elements of the chiller system. Refrigerant fluid vapors developed in evaporator 12 are drawn off by means of a centrifugal compressor 16, which pumps the refrigerant fluid to a higher temperature and pressure. The refrigerant fluid leaving the compressor is passed through a condenser heat exchanger 18. The refrigerant fluid leaving the condenser is flashed to a lower temperature by expansion device 20 before being passed to evaporator 12 to complete the refrigerant fluid loop. The low temperature refrigerant in evaporator 12 is used to cool the chilled water, which in turn cools the environment being serviced by the chiller system.

As the load on the chiller system changes, the chilling capacity of the system is varied to meet load requirements. In the preferred embodiment of the present invention, the chiller system, as shown in FIG. 1, includes microcomputer control device 22 which monitors and controls chiller performance. A variety of microcomputers can be used for the purpose, one example being the 8088 microprocessor.

The control system ultimately controls the position of the pre-rotation vanes (PRVs) and the width of the variable geometry diffuser of the compressor. The changes in the positioning of these elements can affect both the noise generated by the compressor, as well as the stall and efficiency of the compressor. The inventors through experimentation and development have discovered methods and control systems which allow the compressor to be controlled in a manner that provides optimum levels of noise generation and compressor performance.

The control system includes temperature sensor 26 for monitoring the chilled fluid inlet temperature and a temperature sensor 24 for monitoring the chilled fluid outlet temperature. The temperature sensors are preferably thermistors, which, as known in the art, vary the resistance in proportion to the temperature. The control device also includes a flow monitor 28 for determining the flow of water through evaporator 12, a pressure transducer 30 in condenser 18, and a pressure transducer 32 in evaporator 12. Flow monitor 28 preferably determines flow by measuring the pressure differential across the evaporator using either a single differential pressure transducer or two pressure transducers 31 and 33, which measure the pressure of water exiting and entering the evaporator. The various temperature and pressure transducers are electrically connected to the microcomputer 22 in a conventional manner. The computer thus is provided with the values of several operating parameters of the chiller system.

Based upon the information provided to the computer, the computer controls the pre-rotation vanes of the compressor to change the capacity of the chiller system, and controls the width of the variable geometry diffuser to prevent surge and minimize noise. The information in the computer includes a predetermined relationship between given values of one or more measured operational parameters (such as compressor capacity) and the corresponding width of the diffuser that provides the optimum levels of noise generation and performance. The computer sends control signals to a pre-rotation vane actuator 34 and a diffuser width actuator 36 in the compressor. Both actuators preferably include potentiometers which provide feedback on their position to the computer 22. At any given time, the computer thus knows the positions of the pre-rotation vanes, the width of the diffuser, and sensed information indicating whether one or both of the pre-rotation vanes and the variable diffuser should be repositioned.

Figure 2:
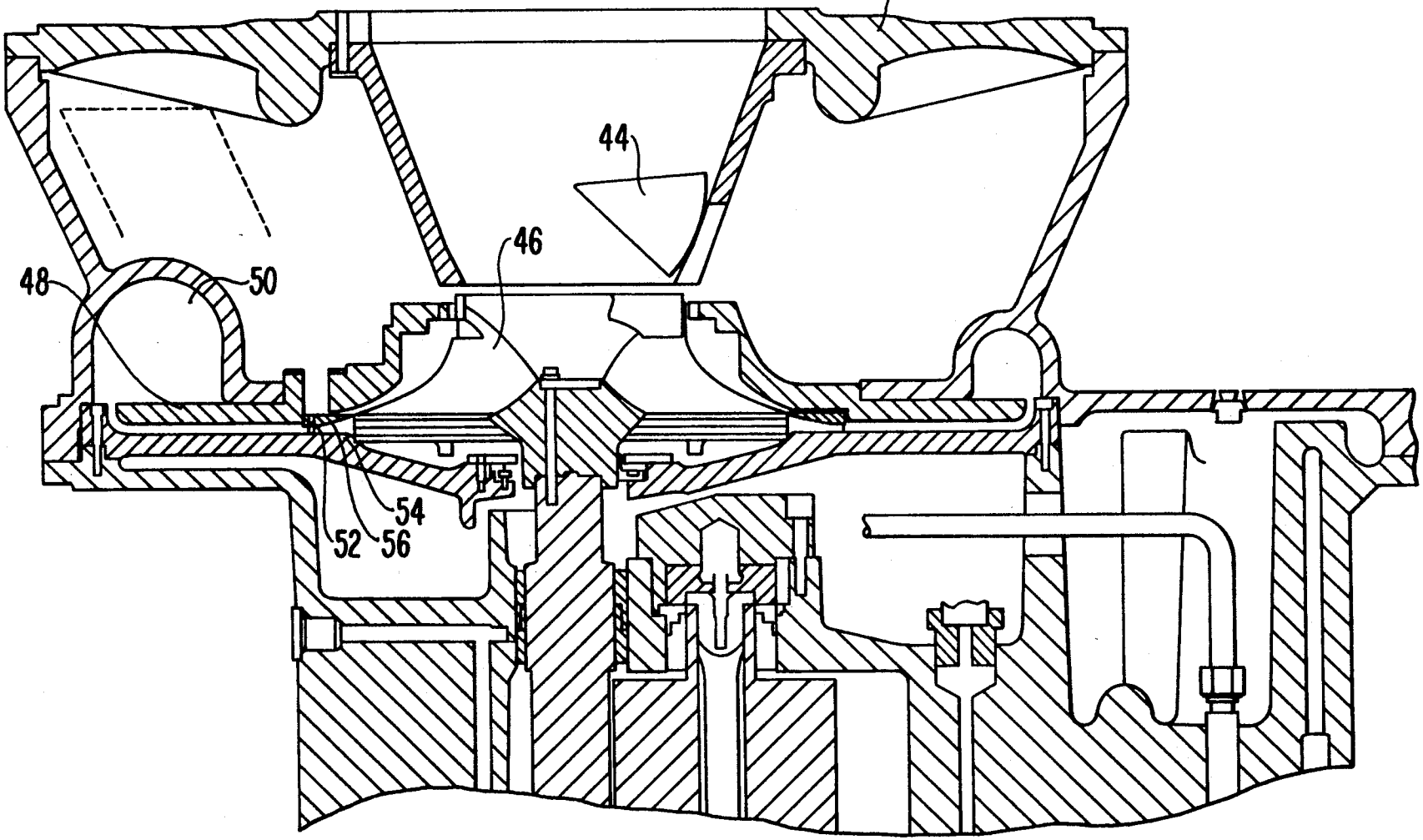
FIG. 2 is a cross-section of a variable geometry compressor to which the present invention may be applied.

In the preferred embodiment of the present invention, the compressor depicted in FIG. 1 is a variable geometry compressor of the type which can vary the width of the diffuser section. Such a compressor, shown in FIG. 2, includes a compressor housing 42, pre-rotation vanes 44 for capacity control, an impeller 46, a base or nozzle base plate 48, a volute 50, and a diffuser 52 at the entrance to the volute 50. The diffuser 52 includes a fixed diffuser surface 54 and a movable diffuser surface 56. The movable diffuser surface 56 is movable relative to the fixed diffuser surface 54 to alter the width of the diffuser 52.

The variable geometry diffuser system includes means for moving the movable diffuser surface 56, and the means can take a variety of different forms. The means includes a mechanical activator (not shown) to drive the movable diffuser surface 56. The actuator preferably is an electrically driven motor which includes a feedback potentiometer which serves as a position sensor. The feedback potentiometer indicates the position of the variable geometry diffuser actuator, and the position of the movable diffuser surface can be determined therefrom. The position sensor also may be designed to directly sense the position of movable diffuser surface 56.

As is conventionally known, a similar type of electrical actuator can be used to move the pre-rotation vanes, as desired. In the preferred embodiment, the actuator for the pre-rotation vanes include a feedback potentiometer which is used to sense the position of the vanes.

It is desirable for the control device to set diffuser width so as to minimize, as much as practically possible, the noise level produced by the compressor in a chiller. The present invention includes a method to determine compressor settings that provide the optimum noise and performance levels at given capacities and to control the variable geometry compressor to operate at minimum noise levels. According to the methods and systems of the present invention, the diffuser inlet width is used as the variable to control noise.

According to the invention, the diffuser inlet throttle width is selected to reduce related noise for the compressor at part-capacity conditions. As explained below, the control is based on evaluation of performance and acoustic data arrived at through testing of a particular compressor. It is recognized that the acoustic and performance characteristics of different compressors may vary to some degree. However, the techniques described below can be applied to different compressors to obtain data which can be used to control a compressor to produce optimum noise levels and performance.

Figure 3:
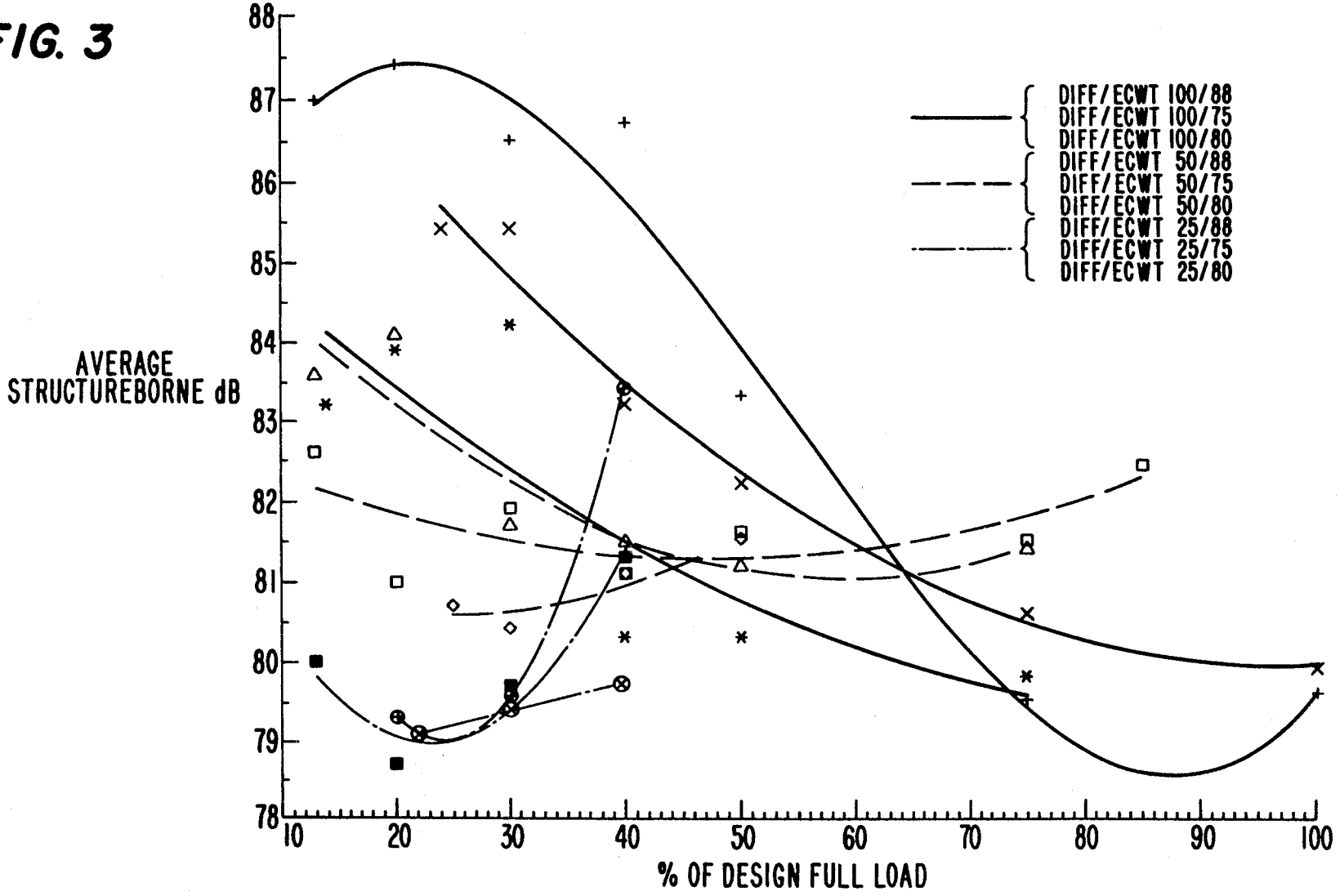
FIGS. 3 and 4 depict data obtained from testing of a chiller system to which the present invention is applied.
Figure 4:
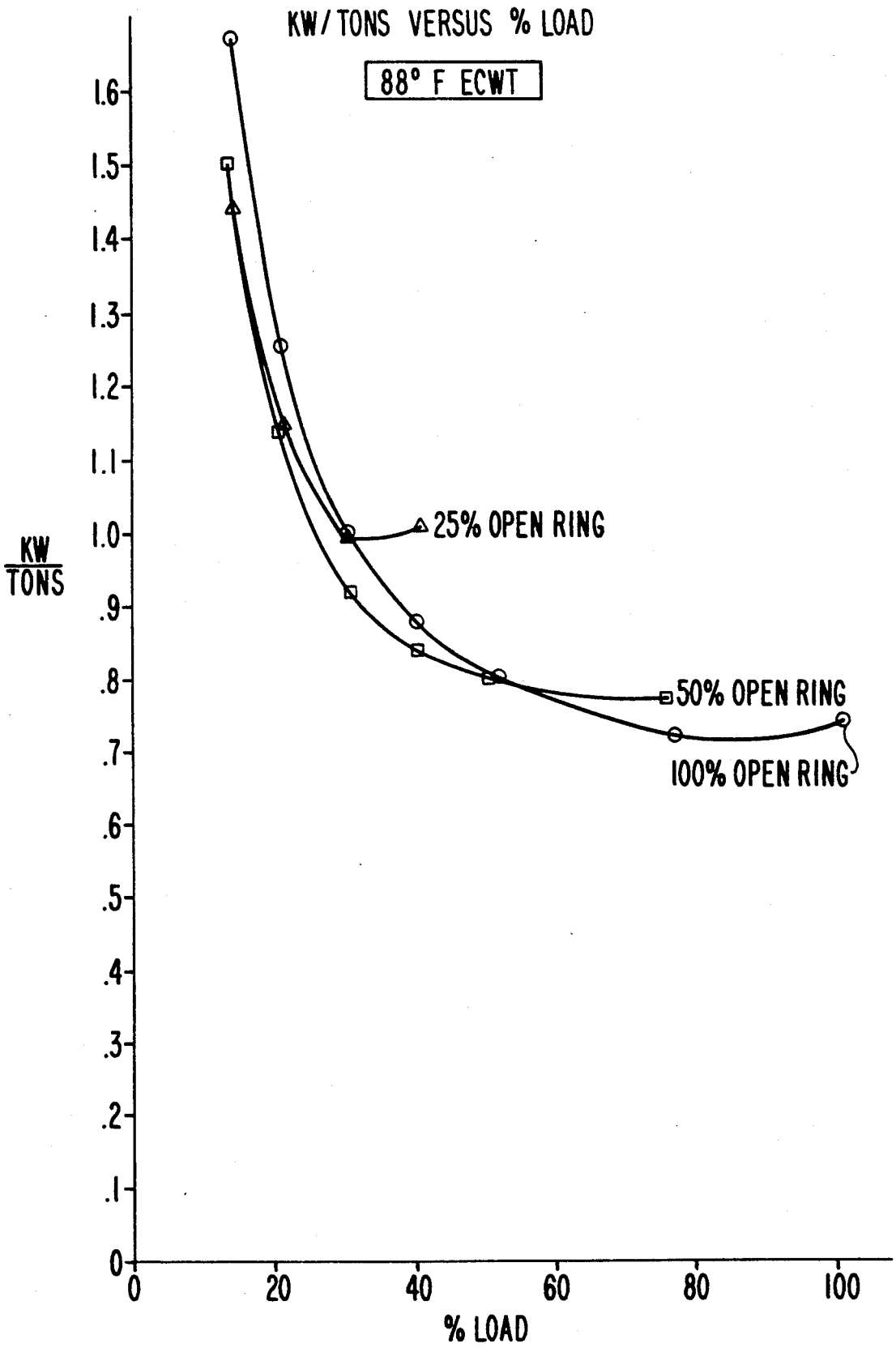

To arrive at the relationship between diffuser width, noise level, and performance, a number of tests were performed on a chiller system like shown generally in FIG. 1. The results of exemplary tests are illustrated in FIGS. 3 and 4. Chiller system tests were performed with three diffuser width settings (DIFF) of 100% open (baseline), 50% open, and 25% open, and entering condenser water temperatures (ECWT) of 88° F., 75° F. and 60° F. FIG. 3 shows representative noise levels at various compressor capacities. For the 25% open diffuser, the noise was minimum at roughly 20% compressor capacity. For the 50% open diffuser, the noise was minimum at roughly 40% capacity. For the 100% open diffuser, the noise was minimized at approximately 90% capacity.

Tests were also performed to determine efficiency as a function of capacity for different diffuser widths. FIG. 4 shows an example for 88° F. water entering the condenser. Tests at other temperatures showed similar results. For the 25% open diffuser, chiller performance deteriorates at capacities higher than 20%, and for the 50% open diffuser, performance deteriorates above 40% capacity. For the 100% open diffuser, the efficiency is best at higher loads. Thus, the data indicates that in terms of minimizing noise and maintaining performance, combinations of 20% capacity/25% open diffuser; 40% capacity/50% open diffuser; and 90% capacity/100% open diffuser are reasonable.

Figure 5:
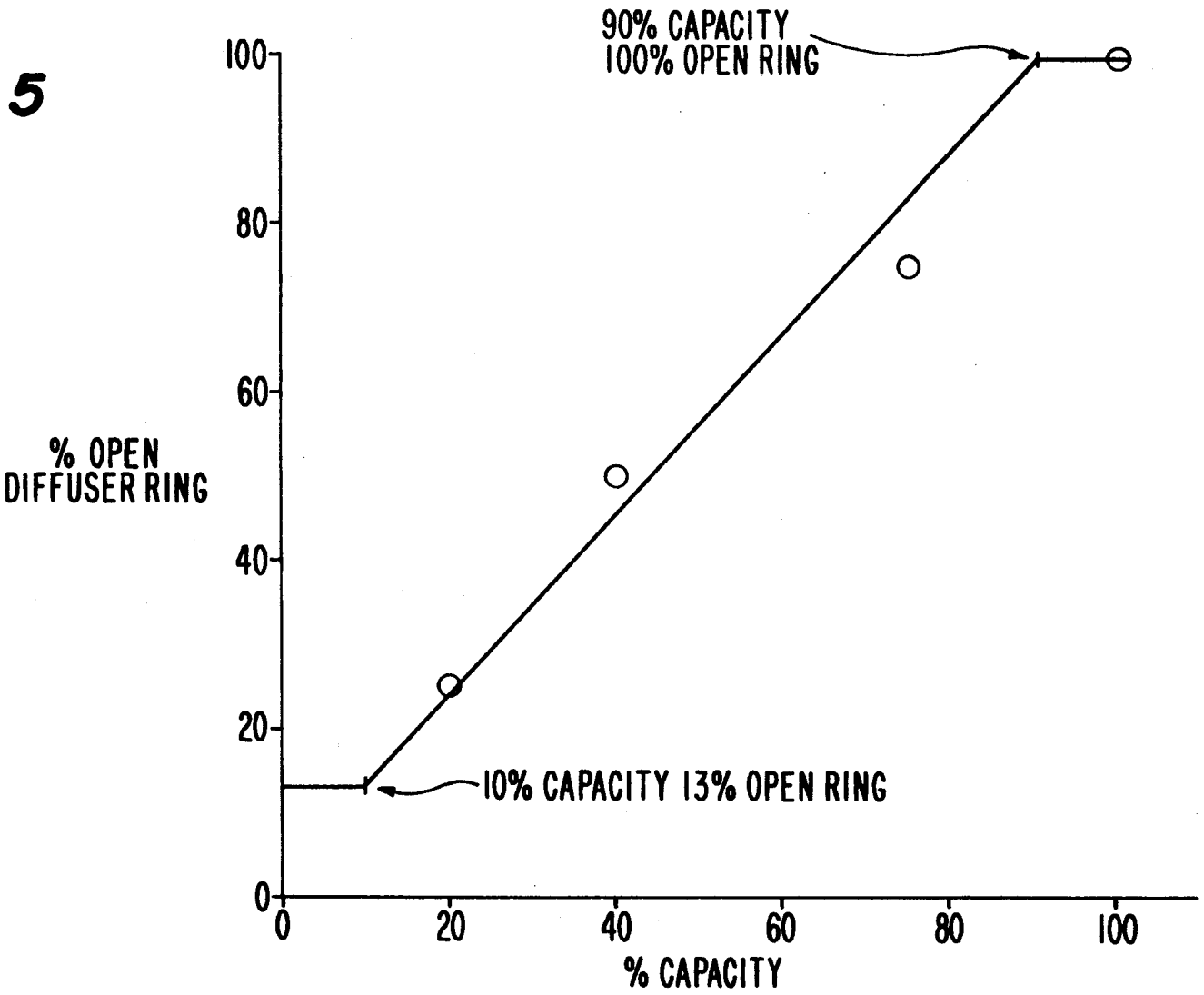
FIG. 5 depicts an algorithm for controlling diffuser width in order to minimize noise.

The data from the test is roughly plotted in FIG. 5 to arrive at an algorithm for setting diffuser width as a function of capacity. For the particular chiller system tested, the resultant algorithm defines the width to be 100% of the maximum width when the capacity is 90% to 100%, and defines the width to linearly vary from 13% of maximum width at 10% capacity to 100% of the maximum width at 90% capacity. Below 10% capacity the width is set at 13% of the maximum width. This curve is represented in FIG. 5. The curve indicates that for a given generating parameter of the chiller system (in this case the capacity of the compressor) there is a preferred width of the variable geometry diffuser to achieve optimum levels of noise and acceptable performance.

Analysis of the experimental data indicate that improved acoustical and efficiency performance can be realized by controlling the width of the diffuser in a centrifugal compressor as a function of the capacity being produced by the compressor. FIG. 5 details one relationship between compressor capacity and diffuser width that will result in such a performance improvement. This particular characteristic was chosen because of the ease in which it can be implemented—i.e. it defines a linear relationship between capacity and diffuser width. Refinements to this characteristic which result in higher order relationships between the capacity and width are possible. For example, more complex characteristics can be generated in which the diffuser width is determined by multiple parameters (e.g. capacity and pressure head across the compressor as measured by pressure transducers 30 and 32). Differences in application requirements determine how the balance between complexity of implementation and the level of performance improvement should be struck.

Figure 6:
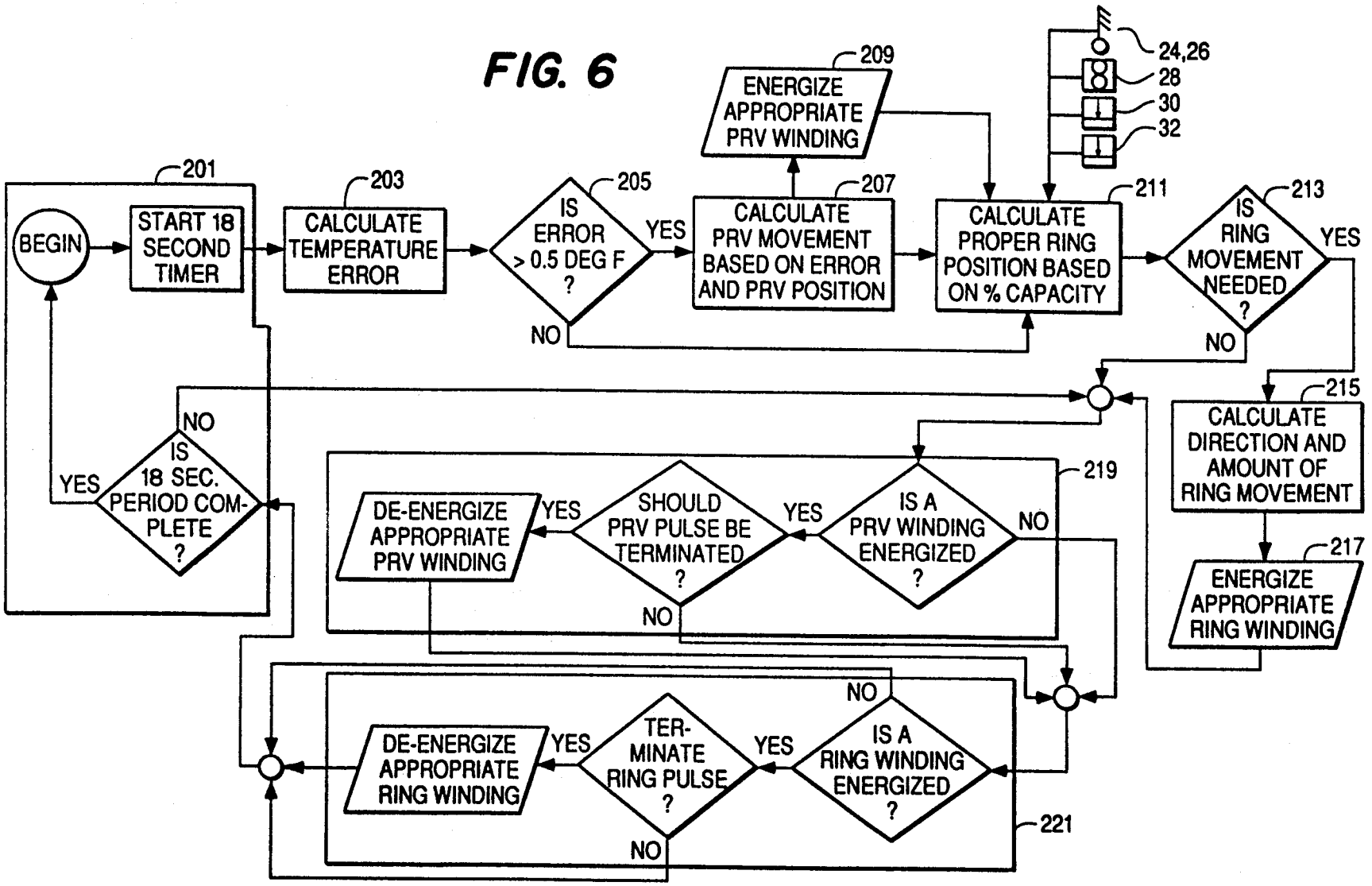
FIG. 6 is a schematic illustration of a control system made according to the present invention.

The control system illustrated generally in FIG. 1 can be used to implement the above-discussed algorithm. A flow chart describing generally the sequence of operation is shown in FIG. 6. The control logic is executed periodically. In the preferred embodiment the logic is executed every 18 seconds (step 201). However, any time period may be chosen as long as the time period is sufficiently long to provide for stable setting of the pre-rotation vane position and diffuser width. FIG. 6 is a block diagram that describes the manner in which the diffuser is moved to implement the width characteristic defined by the plot, or algorithm, shown in FIG. 5. This block diagram shows that diffuser movement is closely tied to movement of the compressor's pre-rotation vanes. This relationship is necessary to insure stable operation. The 18 second timer is used to allow time for the system to respond to pre-rotation vane and diffuser movements before decisions about the requirements for additional movements are made.

In the preferred embodiment, the pre-rotation vanes are positioned to maintain the outlet water temperature at a preselected level. A desired outlet temperature is set which may be, for example, between 34° F. and 59° F. (nominally 44° F.). This set temperature is compared to the actual outlet temperature (step 203) measured by temperature sensor 31.

If the temperature error is greater than 0.5° F. (step 205), then the desired motion of the pre-rotation vanes is determined (step 207). The pre-rotation vane actuator is then energized by the computer to move the desired amount (step 209).

Next the desired diffuser width is calculated (step 211), according to the sensed value of an operational parameter, such as the capacity. If the temperature error is less than 0.5° F. (step 205), then the pre-rotation vane calculations do not occur and the diffuser width is calculated (step 211) without intervening steps.

FIG. 6 indicates that the amount of pre-rotation vane movement is calculated prior to determining the amount of diffuser ring movement, but this order is not essential. It is important that both calculations and the movements resulting from them occur at the beginning of the 18 second period so that the changes that result from them have taken effect prior to the time that the next calculation is made. The block labeled "CALCULATE PROPER RING POSITION BASED ON % CAPACITY" assumes that a relationship has been chosen in which the diffuser width is determined solely by compressor capacity. The presently preferred embodiment of the invention varies the diffuser width according to capacity, or signals representative of capacity, but the invention is not so limited. This block would be modified accordingly if other or additional parameters were included in the determination of the diffuser width.

Numerous references are made in the FIG. 6 to "PRV winding" and "Ring winding". These references are based on using one type of electrical actuator to position the pre-rotation vanes and the diffuser ring. This type of actuator includes a two winding motor in which the direction of rotation is determined by which of the two windings is energized. The rotational movement of these actuators is translated mechanically into the type of motion necessary to position the pre-rotation vanes and the diffuser ring. Other methods of positioning the pre-rotation vanes and the diffuser ring would be accommodated by appropriate changes to the block diagram.

The diffuser width is calculated using the algorithm of FIG. 5, or a similarly derived algorithm. This algorithm is preferably contained in software in the microcomputer. In the preferred embodiment capacity of the compressor is determined indirectly by measuring the flow through the evaporator using a flow monitor 28 (including a differential pressure transducer, or pressure transducers 31 and 33), and the input temperature of water to and the output temperature of water from the evaporator using temperature sensors 26 and 24. Considering the defined specific heat of water, capacity can be determined by the formula $$\% \text{ CAPACITY} = \left( \frac{\frac{(T_{inl} - T_{out})\text{FLOW}}{24}}{(\text{Max. Cooling Capacity in Tons})} \right) \times 100$$

Flow may be determined by the formula $$\text{FLOW}_{act} = \text{FLOW}_m \times \sqrt{\frac{P_{act}}{P_m}}$$

where $\text{Flow}_m$ and $P_m$ are constants determined empirically by running a rated flow through the evaporator and measuring the corresponding pressure drop. $P_{act}$ is the actual pressure drop.

If a change in the diffuser width is needed (step 213), the direction and amount of ring movement is calculated (step 215), and the ring actuator is energized (step 217). The actual time of both pre-rotation vane movement (step 219) and ring movement (step 221) is monitored, and when the time necessary to move the vanes or diffuser the desired amount has elapsed, the actuator is turned off. Both pre-rotation vane movement and ring movement may be terminated prior to the scheduled time if anomalous conditions are encountered.

This control system preferably includes means to prevent overloading the compressor motor. For example, if the motor current increases to 100% of its full load value, the pre-rotation vanes are not allowed to move open (they can still close). If the motor current continues to rise until it exceeds 104% of its full load value, the pre-rotation vanes are forced to close. Closing continues until the motor current drops to less than 102% of the full load value. Once in this "current limit" mode, the motor current must fall to less than 98% of the full load value before the pre-rotation vanes are allowed to open.

The control system also preferably includes means to prevent the unit from shutting down because of a low evaporator temperature condition. If the evaporator temperature falls to a value less than 36° F., the pre-rotation vanes are not allowed to move open (they can still close). If the evaporator temperature continues to fall until it drops below 35° F., the pre-rotation vanes are forced to close. Closing continues until the evaporator temperature rises to a value greater than 35.5° F. Once in the "evaporator temperature limit" mode, the evaporator temperature must rise to a value greater than 37° F. before the pre-rotation vanes are allowed to open.

It will be apparent to those skilled in the art that various modifications and variations can be made to the present invention without departing from the scope or spirit of the invention.

Other embodiments of the invention will be apparent to those skilled in the art from consideration of the specification and practice of the invention disclosed therein. It is intended that the specification and examples be considered as exemplary only, with a true scope and spirit of the invention being indicated by the following claims.

What is claimed is:

1. A control system for a centrifugal compressor having pre-rotation vanes and a variable width diffuser, the device comprising:

means for controlling a position for the pre-rotation vanes to achieve a desired capacity;

means for sensing a parameter representative of the capacity of the compressor; and means, interconnected with said sensing means, for controlling the width of the diffuser section to control noise generated by the compressor to an acceptable level.

2. The control system of claim 1, wherein said width controlling means includes a memory containing a predetermined relationship between the sensed parameter and the noise generated by the compressor.

3. The control system of claim 2 wherein said width controlling means includes a microcomputer.

4. The control system of claim 3 wherein said microcomputer includes a software program to correlate the width of the diffuser with the sensed parameter according to the predetermined relationship.

5. The control system of claim 1, wherein the compressor is used in a chiller having an evaporator with chilled water flowing therethrough and a condenser, and wherein the width controlling means includes:

a flow meter for measuring the flow of chilled water through the evaporator;

a first temperature sensor for measuring an input temperature of chilled water flowing to the evaporator;

a second temperature sensor for measuring an output temperature of chilled water flowing from the evaporator; and circuitry for calculating the desired width of the diffuser section, based upon the measured flow and temperature, in order to control noise at an acceptable level.

6. A control system for a centrifugal compressor having a variable width diffuser, the system comprising:

means for sensing a variable operational parameter of the compressor;

means for varying the width of the variable width diffuser;

control means, interconnected with said sensing means and said width varying means and including a memory containing a predetermined relationship between the sensed operational parameter and the noise generated by said compressor, for causing the width varying means to vary the width of the diffuser to minimize noise created by the compressor at the sensed operational parameter.

7. The system of claim 6 wherein said control means includes a microcomputer.

8. The system of claim 6 wherein said microcomputer includes a software program to correlate the width of the diffuser with the sensed parameter according to the predetermined relationship.

9. A control system for a chiller system including a centrifugal compressor capable of operating at different capacities having variable pre-rotation vanes and a variable width diffuser; an evaporator heat exchanger for producing chilled water; a condenser heat exchanger; and an expansion device; the system comprising:

first means for sensing a water temperature of the chilled water produced by the evaporator heat exchanger and developing an error signal representative of a difference between the sensed water temperature and a preselected desired water temperature;

second means for sensing at least one additional operational parameter of the chiller system, the at least one additional operational parameter being indicative of the level of noise generation in the compressor;

third means for varying a position for the pre-rotation vanes;

fourth means for varying the width of the variable width diffuser;

and control means, interconnected with said first, second, third and fourth means, for periodically varying the position of the pre-rotation vanes to minimize the error signal and for periodically varying the width of the variable width diffuser to achieve acceptable noise generation and performance, according to a predetermined relationship between the additional operational parameter and the width of the variable width diffuser.

10. The control system of claim 9 wherein said second means for sensing senses the capacity of the compressor.

11. The control system of claim 9 wherein the chilled water is produced by flowing it through the evaporator heat exchanger and wherein said second means for sensing senses the flow of chilled water through the evaporator, a temperature of chilled water flowing into the evaporator, and a temperature of the water flowing out of the evaporator.

12. The control system of claim 10 wherein said control means is a computer that derives a signal representative of capacity from the flow and temperature sensed by said second sensing means.

13. A method of controlling a centrifugal compressor, including a diffuser having a variable width, to minimize noise generation, the compressor being capable of operating at different capacities, the method comprising the steps of:

defining the width of the diffuser which results in an acceptable level of noise generation and performance at given values of an operational parameter of the compressor, the operational parameter being indicative of the level of noise generation;

periodically sensing the operational parameter of the compressor; and periodically varying the diffuser width according to the sensed operational parameter to effect a diffuser width that results in the acceptable level of noise generation and performance at the sensed value of the operational parameter.

14. The method of claim 13, wherein the step of defining defines the diffuser width based at least on the capacity at which the compressor is operating and the sensed operational parameter is the capacity of the compressor.

15. The method of claim 14, wherein the compressor is in fluid communication with an evaporator, the evaporator having a cooling fluid passing therethrough, and further comprising the step of determining the capacity of the compressor by measuring a flow and a temperature difference of the cooling fluid passing through the evaporator.

16. The method of claim 13 wherein the width of the diffuser is defined by the defining step to be at a maximum width when the compressor is operating at a first capacity greater than 80% of a maximum capacity and wherein the width of the diffuser is defined to be at a minimum width of less than 20% of the maximum width when the compressor is operating at a second capacity values of less than 15% of the maximum capacity.

17. The method of claim 16 wherein the width of the diffuser is defined by the defining step to linearly increase from the minimum width at the second capacity to the maximum width at the first capacity.

18. The method of claim 17 wherein the width is defined by the defining step to linearly vary from less than 15% of the maximum width at approximately 10% capacity to 100% of the maximum width at approximately 90% capacity.

19. The method of claim 13 wherein the step of defining includes a substep of performing tests on the compressor to determine the relationship between the value of the operational parameter, the noise generated by the compressor, and efficiency of the compressor.

20. The method of claim 13 wherein the sensed parameter includes pressure head across the compressor.

21. A method of controlling a chiller system including an evaporator heat exchanger for producing chilled water and a centrifugal compressor having a variable width diffuser section and a variable capacity, the method comprising:

selecting a desired temperature of the chilled water;

periodically sensing the temperature of the chilled water;

periodically comparing the sensed temperature with the desired temperature to obtain an error signal;

periodically varying the capacity of the compressor to minimize the error signal;

periodically sensing one or more parameters representative of the capacity of the compressor; and periodically varying the width of the diffuser section, based upon the sensed parameter and a defined relationship between the sensed parameter and noise level, to control noise generation at an acceptable level.

22. The method of claim 21 wherein the defined relationship is a linear relationship.

* * * * *